US005523646A

United States Patent [19]

Tucciarone

[11] Patent Number: 5,523,646

[45] Date of Patent: Jun. 4, 1996

[54] AN ARC CHAMBER ASSEMBLY FOR USE IN AN IONIZATION SOURCE

[76] Inventor: John F. Tucciarone, c/o Semicon Precision Industries Rte. 22, S. Paterson Business Park, Brewster, N.Y. 10509

[21] Appl. No.: 291,759

[22] Filed: Aug. 17, 1994

[51] Int. Cl.[6] ..... H05H 1/24

[52] U.S. Cl. ..... 313/359.1; 313/588; 250/281

[58] Field of Search ..... 313/359.1, 588; 250/281

[56] References Cited

U.S. PATENT DOCUMENTS

| | | | |
|---|---|---|---|
| 2,499,289 | 2/1950 | Backus | 250/426 |
| 2,669,609 | 2/1954 | Linder | 330/41 |
| 2,754,422 | 7/1956 | Lofgren et al. | 250/425 |
| 2,909,697 | 10/1959 | Bornas et al. | 313/363 |
| 2,930,917 | 3/1960 | Nief | 313/361.1 |
| 3,287,598 | 11/1966 | Brooks | 514/391 |
| 3,517,240 | 6/1970 | Dickenson | 313/361.1 |
| 3,610,985 | 10/1971 | Fleming et al. | 313/361.1 |
| 3,678,267 | 7/1972 | Werner | 250/427 |
| 3,742,275 | 6/1973 | Gutow, Jr. | 313/360.1 |
| 3,784,858 | 1/1974 | Franks | 313/359.1 |
| 4,412,153 | 10/1983 | Kalfbus et al. | 315/111.81 |
| 4,481,062 | 11/1984 | Kaufman et al. | 156/345 |
| 4,608,513 | 8/1986 | Thompson | 313/359.1 |
| 4,760,262 | 6/1988 | Sampayan et al. | 250/423 R |
| 4,862,032 | 8/1989 | Kaufman et al. | 313/359.1 |
| 4,883,969 | 11/1989 | Ishida et al. | 250/427 |
| 4,891,525 | 1/1990 | Frisa et al. | 250/423 R |
| 5,105,123 | 4/1992 | Ballou | 315/111.21 |

*Primary Examiner*—Donald J. Yusko
*Assistant Examiner*—Lawrence O. Richardson

[57] ABSTRACT

An Arc Chamber Assembly for use in an Ionization Source for dissociating to a desired ion form an element or compound of a material and ionizing such element or compound to provide a beam of charged particles. The chamber is enclosed within a structure having separate sides and ends and top and bottom and having a filament extending through the chamber, the filament having two end sections, each located along the same longitudinal axis with a central section offset from the end sections, but having a longitudinal axis parallel to the end sections, the filament further having two loops of essentially 180 degrees each separating the central section from the two end sections.

10 Claims, 3 Drawing Sheets

AN ARC CHAMBER ASSEMBLY FOR USE IN AN IONIZATION SOURCE

BACKGROUND OF THE INVENTION

Ion sources of various types are known. In such devices, an element or compound is dissociated and ionized in a plasma discharge process for use in an ion implantation apparatus. The ions are extracted from the source by means of electric extraction fields to provide a beam of charged particles. The beam includes the desired ions which are subsequently separated from the beam by mass charge separation techniques.

It is known in the art to have a filament inside a chamber formed by a shield to produce the ionization of the gas being utilized. The temperatures created by the ionization in such a chamber are very high and the quality of material which is required in the manufacture of the chamber is extensive resulting in high cost to produce such a chamber.

The filaments also are subjected to extremely high temperatures and do fail as a result. Down time lowers production and in view of the cost of such equipment, can be very costly.

This invention limits exposure from the ionization process to the filament and insulates the majority of the chamber by use of separate side and end walls and a separate top and bottom thus increasing the heat reflection into the center of the hot zone. The flow of the plasma is directed toward the aperture. The configuration of the chamber increases the heat reflection into the center of the hot zone and the configuration of the filament removes it from the hot zone. As a result, a truer beam is accomplished resulting in lower power consumption while creating greater consistency, and reducing non-burnt residue and increasing life span of components.

SUMMARY OF THE INVENTION

In accordance with the present invention, an arc chamber assembly for use in an Ionization Source is produced by having a shield which forms a chamber in which the ionization process occurs. The shield is cylindrical and has convex end members at each end of the cylinder and which is separate from the housing assembly in which the shield is mounted. An aperture is formed through the shield. The interior of the end members is concave. The concave configuration of the end members and the cylindrical shape of the cylinder direct the plasma created by the ionization process to a central point in the chamber adjacent the aperture within the shield.

A heated filament is used within the shield to form the heat source. The filament has two end sections, both linear and aligned with one another. The filament is located along the longitudinal axis of the cylinder which forms the shield. The filament also has a central portion which is offset from and parallel to the two end sections. Between the central section and both end sections a loop is formed. The loops are located in planes generally parallel to the longitudinal axis of the end portions. The two loops are each bent in opposite directions.

By use of the housing assembly to support the shield structurally, the shield itself requires a comparatively limited amount of material and thus may be made more inexpensively from an expensive material. The shield is held in place within the housing assembly which includes a base plate, two end plates, two side plates, and a top plate. Beneath the top plate is a shim. In the top plate there is an aperture, and in the shim there is an aperture both of which align with each other and with the aperture in the shield.

In one side plate there is a gas port which extends into the shield for the injection of gas into the shield in the presence of the electrically charged filament. The filament itself passes through the end members of the shield and through the end plates and is insulated electrically from the end plates by means of grommets. The shield is also held firmly in a spaced relationship to the housing assembly by means of standoffs which are ceramic units mounted in the side wall and base plate with an end which is fitted into an indentation in the shield. The inlet port also has a ceramic inlet port which also serves to hold the shield in place.

The configuration of the shield directs the plasma created by the ionization process into one central point in the chamber directly opposite the aperture. Due to the configuration of the filament, more particularly the loops, the filament is located outside the central point and is thus kept out of the intense heat of the central point where ionization is taking place. The filament is further kept out of the path of the particle beam as such particle beam is extracted from the shield through the aperture.

it is an object of the present invention to provide an improved plasma source requiring lower energy sources and higher temperatures.

It is another object of the present invention to provide for increased life of the unit, and more particularly increased life of the filament.

It a further object of the present invention to provide an ion source assembly with an ionization chamber which can be structurally produced of less expensive materials while limiting the shield to the use of those more expensive materials necessary to produce a high quality particle beam.

It is a further object of the present invention to produce an arc chamber assembly for use in an Fonization Source having a longer life by elimination of damage from the reaction zone on the filament and on other parts of the unit.

It is a further object of the invention to produce an arc chamber assembly for use in an Fonization Source where wear parts can be more readily and inexpensively replaced without the production of an entire ionization source assembly.

The subject matter of the present invention is particularly pointed out and distinctly claimed in the concluding portion of the specification. However, both the organization and method of operation, together with further advantages and objects thereof, may be best understood by reference to the following description taken in connection with the accompanying drawings wherein like reference characters refer to like elements.

DETAILED DESCRIPTION OF THE INVENTION

Figure 9:
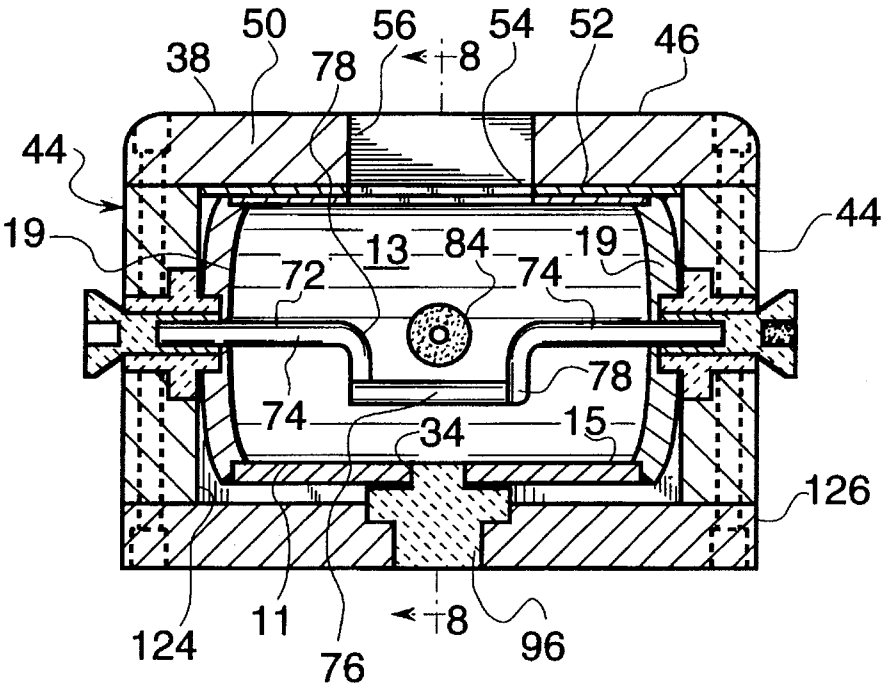
FIG. 9 is a cross sectional view of the ionization source assembly taken along the longitudinal axis of the shield and being along line 9—9 of FIG. 8.
Figure 8:
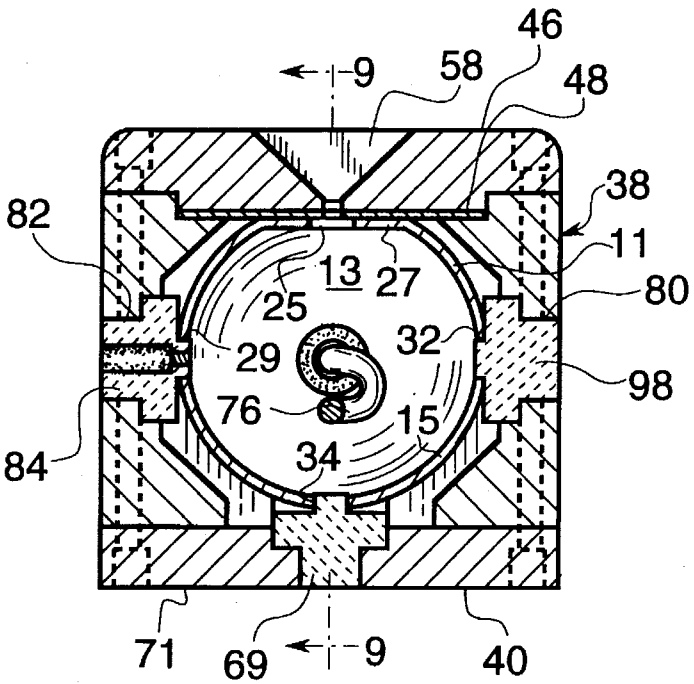
FIG. 8 is a cross sectional view of the ionization source assembly taken at right angles to the longitudinal axis of the shield and being taken along line 8—8 of FIG. 9.
Figure 10:
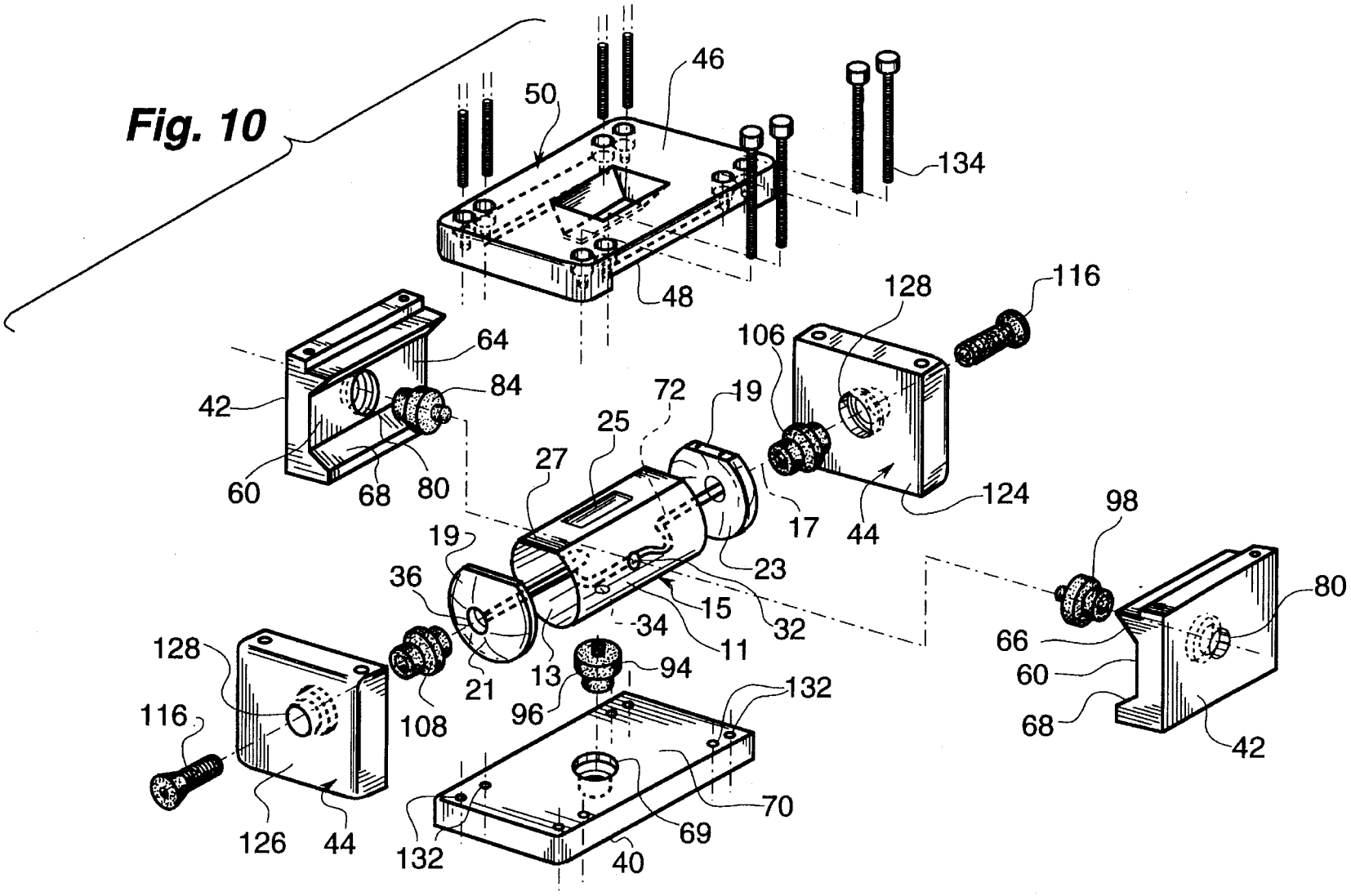
FIG. 10 is an exploded view of the ionization source assembly.

Referring now to the drawings and particularly to FIGS. 8, 9, and 10, a shield 11 is shown. The shield 11 which forms a chamber 13 includes a cylinder 15 which has a longitudinal axis 17. The shield 11 also has two end members 19, the external surface 21 of which is convex and the internal surface 23 of which is concave. One end member 19 of the shield 11 is rigidly affixed to the cylinder 15 and the other end member 19 is removable from the shield 11 for purposes of entering the interior of the chamber 13.

Through the cylinder 15, there is an aperture 25 which is aligned with the longitudinal axis 17 of the cylinder 15 and which is rectangularly shaped. The cylinder 15 is not perfectly cylindrical but has a flat area 27 running longitudinally along the surface of the cylinder 15. The aperture 25 is located generally centrally within the flat area 27. A port opening 29 is formed generally midway along one side of the cylinder 15 at approximately ninety degrees from the aperture 25.

A side indentation 32 is also formed directly opposite the port opening 29 in the cylinder 15 and a base indentation 34 is formed at a right angle to both the side indentation 32 and the port opening 29 and is also opposite the aperture 25. Each end member 19 has an end opening 36 in it which is centrally located. The shield 11, including the cylinder 15 and both end members 19, is held in place by means of a housing assembly 38 which supports, contains, and insulates the shield 11 and reflects heat back into the shield 11.

Since the shield 11 is contained within and supported by the housing assembly 38, the shield 11 need not have all the structural strength required of the complete ionization source assembly. In this way, the shield 11 can be made from expensive materials and the housing assembly 38 can be made from much less expensive material with a total cost which is reasonable. On the other hand, if the entire ionization source assembly were made in one piece or nearly one piece from the expensive material necessary to construct the shield 11, the material costs would be prohibitive.

The housing assembly 38 includes a base plate 40, two side plates 42, two end plates 44 and a top plate 46. The top plate 46 has an interior surface 48 and an exterior surface 50 and a shim 52 is located against the interior surface 48 of the top plate 46. The aperture 25 in the shield 11 is rectangular in shape with generally parallel side walls resulting in an even cross section. The shim 52 has apertures 54 through it and the top plate 46 has an aperture 56 through it. These two apertures 54, 56, align with each other with the aperture 25 in the shield 11. The aperture 54 through the shim 52 is also rectangular and of the same configuration and size as the aperture 25 through the shield 11. The aperture 56 through the top plate 46 at the interior surface 48 of the top plate 46 is generally similar to the aperture 54 through the shim 52 but as best seen in FIG. 8, the aperture 56 through the top plate 46 is divergent along the longitudinal axis of the aperture 56 through the top plate 46. This divergence of the aperture 56 through the top plate 46 results in the aperture 56 in the exterior surface 50 of the top plate 46 being wider than in the interior surface 48 of the top plate 46.

The aperture 25 in the shield 11, the aperture 54 in the shim 52 and the aperture 56 in the top plate 46 form the aperture 58 for the ionization source assembly from which the particle beam formed in the ionization process in the chamber 13 is extracted from the shield·11.

Each side plate 42 has an interior surface 60 and an exterior surface 62 The interior surface 60 of the side plates 42 has a central area 64 and a top area 66 and a bottom area 68. The central area 64 is vertical and the bottom area 68 and top area 66 are located at an acute angle to the central area 64.

The base plate 40, has an opening 69 through it generally centrally located. The base plate 40 like the top plate 46, has an interior surface 70 and an exterior surface 71. As a result of the acute angles of the top area 66 and the bottom area 68 to the central area 64, and the interior surface 48 of the top plate 46, the interior surface 70 of the base plate 40, the cross section of the interior of the housing assembly 38 is a multiplicity of chords about a circle.

Figure 1:
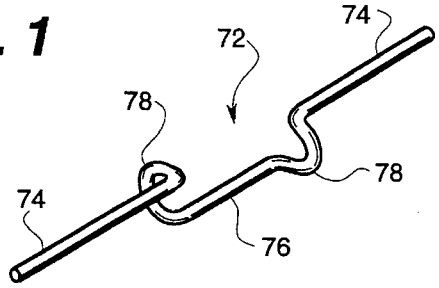
FIG. 1 is a pictorial view of the filament.

A filament 72 as best seen in FIGS. 1 and 9 has two end sections 74 and a central section 76. The central section 76 is separated from each end section 74 by means of a pair of loops 78. The plane in which the loops 78 are generally parallel to one another and are at right angles to the longitudinal axis of the two end sections 74 which are generally aligned with one another. The two loops 78 are each formed in opposite directions from each other, but are connected to each other by the central section 76 of the filament 72 which lies offset but parallel with the two end sections 74.

Each side plate 42 has an opening 80 in it generally centrally located in the side plate 42. The opening 80 in each side plate 42 has a larger diameter at the interior surface 60 than at the exterior surface 62. The opening 80 in one side plate 42 is aligned with the port opening 29 in the cylinder 15 forming a gas inlet port 82 through which the gas being used for the ionization process is introduced into the chamber 13.

Figure 4:
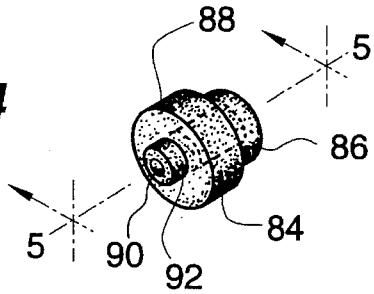
FIG. 4 is a pictorial view of the ga inlet port.
Figure 5:
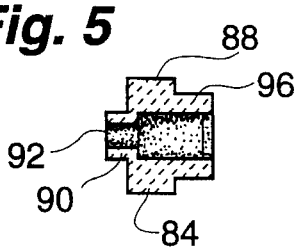
FIG. 5 is a cross sectional view taken along line 4—4 of FIG. 4.

An inlet conduit 14, best shown in FIGS. 4 and 5, is mounted in the gas inlet port 82 as shown in FIG. 10. The inlet conduit 84 is cylindrical and has three concentric units, each with a different diameter. A medium diameter unit 86 is inserted into the gas inlet port 82 from the interior of the housing assembly 38. A large diameter unit 88 adjoins the medium diameter unit 86 and inserted into the opening 80 at the interior surface 60 of the side plate 42. A small diameter unit 90 is located on the opposite side of the large diameter unit 88 from the medium diameter unit 88 and fits into the port opening 29 in the shield 11. A passageway 92 is located concentrically through the inlet conduit 84. The large diameter unit 88 has a larger diameter than the diameter of the medium diameter unit 86 and the diameter of the medium diameter unit 86 is larger than the diameter of the small diameter unit 90. The medium diameter unit 88 extends to the exterior surface 62 of the side plate 42. The inlet conduit 84 is electrically insulated and is highly heat resistant.

Figure 2:
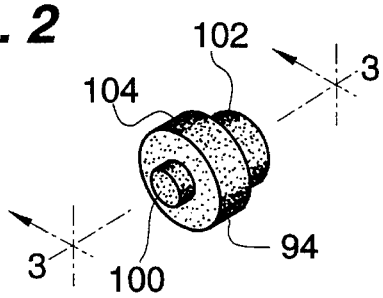
FIG. 2 is a pictorial view of the standoff used to hold the shield in a space relationship within the housing assembly.
Figure 3:
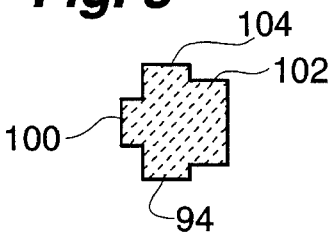
FIG. 3 is a cross section taken along line 3—3 of FIG. 2.

As best shown in FIG. 2, standoffs 94 are also used. There are two standoffs 94, namely a base standoff 96 and a side standoff 98, both shown in FIG. 10. Each standoff 94 with the exception of the passageway 92 is the same as the inlet conduit 84. Each standoff 94 has the same three parts, namely a small diameter part 100, a medium diameter part 102 and a large diameter part 104, but since the standoffs 94 do not include a passageway 92, they are solid units and are not used for any inlet purposes.

Figure 6:
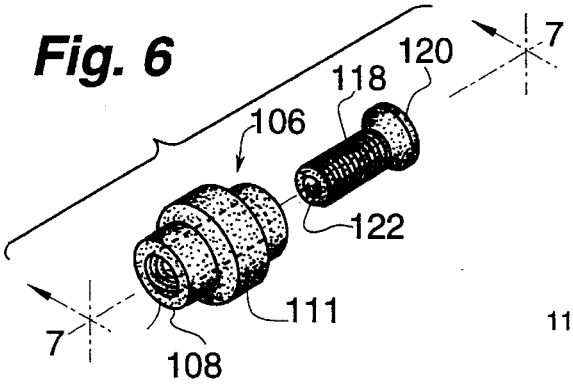
FIG. 6 is a pictorial view of the grommet used to hold the filament within the shield including both the base grommet and the plug grommet.
Figure 7:
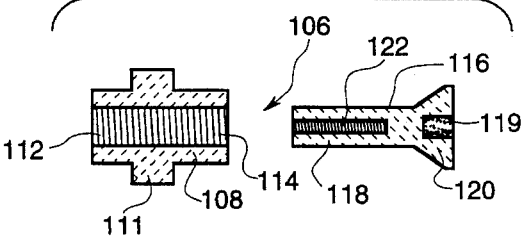
FIG. 7 is a cross sectional view of the grommet used to hold the filament taken along line 7—7 of FIG. 6.

The filament 72 is held in place by grommets 106, which are shown in FIGS. 6 and 7. The grommets electrically insulate the filament 72 from the shield 11 and the housing assembly 38. The grommets 106 are also highly heat resistant. The grommets 106 include a cylindrical part 108 with a collar 110 having a larger diameter than the cylindrical part 108. A channel 112 is located concentrically through the cylindrical part 108 and is threaded with a female thread 114. A plug unit 116 which has a male thread 118 to mate with the female thread 114 of the cylindrical part 108, is threaded into the cylindrical part 108. The plug unit 116 has a head 120 which is located at the end of the plug unit 116 opposite from the male thread 118. A concentric opening 119 extends from the head 120 partway into the plug unit 116 and another concentric opening 122 from the end of the plug unit 116 back up toward the head 120, but not all the way through the plug unit 116, so that no through passageway is created by the concentric opening 119 and the concentric opening 122. The concentric opening 119 into the head 120 is used for the purposes of putting a wrench into the plug unit 116 and the concentric opening 122 extending from the opposite end of the plug unit 116 is used to hold the end sections 74 of the filament 72 in place.

As best seen in FIG. 10, each end plate 44 has an interior surface 124 and an exterior surface 126. An opening 128 is located generally centrally in each end plate 44. The opening 128 in the end plate 44 has a larger diameter at the interior surface 124 of each end plate 44 than in the exterior surface 126 of each end plate 44. Similarly, each end member 19 of the shield 11 has an opening 36 concentrically located through it. The opening 36 through the end member 19 and the openings 128 in the end plates 44 align with one another. The opening 36 in each end member 19 of the shield 11 has a diameter virtually the same as the opening 128 at the external surface 126 of the end plate 44.

The collar 110 of each grommet 106 is inserted from the interior surface 124 of an end plate 44 into the opening 128. One end of the cylinder 108 is inserted into the opening 36 in the end member 19 of the shield 11. The plug unit 116 is then placed through the exterior surface 126 of each end plate 44 and threaded into the female thread 114 with the filament 72 held in place by the concentric openings 122 of the grommets 106.

As has been previously stated, the cylinder 15 has a side indentation 32 and a base indentation 34. The base standoff 96 is inserted into the opening 69 in the base plate 40 from the interior surface 70 of the base plate 40. The opening 69 in the base plate 40 has a larger diameter at the interior surface 70 than at the exterior surface 71. The larger diameter part 104 fits into the opening 69 in the interior surface 70 of the base plate 40, and the medium diameter part 102 extends to the exterior surface 71 through the opening 69. The small diameter part 100 is inserted into the base indentation 34.

The side standoff 98 is essentially the same as the base standoff 96. The side standoff 98 is inserted into opening 80 in the side plate 42 from the interior surface 60 of the side plate 42. The larger diameter part 104 fits into the opening 80 in the interior surface 60 of the side plate 42 and the medium diameter part 102 extends to the exterior surface 62 of the side plate 42 through the opening 80. The small diameter part 100 is inserted into the side indentation 32.

The electrical circuitry for charging the filament 72 is known in the art and would operate in the same or similar manner to existing ionization source assemblies.

The two end plates 44 are placed down on the base plate 40 and the two side plates 42 can be put in place with the inlet conduit 84 and the standoffs 94 in place. The base plate 40 has threaded bolt holes 132 located in it, two for each end plate 44 and two for each side plate 42. With the top plate 46 in place, bolts 134 are extended down through the end plates 44 and the side plates 42 into the base plate 40 and threaded into the threaded bolt holes 132 in the base plate 40 securing the entire ionization source assembly together.

In this way, the shield 11 is located centrally within the ionization source assembly and is spaced away from the housing assembly 38. Heat from the shield 11 is radiated back into the shield 11 from the housing assembly 38 which is insulated to a degree by the space between the housing assembly 38 and the shield 11, making possible the use of less expensive materials for the housing assembly 38. The shape of the filament 72 the concave interior surface 23 of the end members 19 and the shape of the chamber 15, cause the ionization process to be centered in the shield 11 adjacent the aperture 58 and the filament 72 by its configuration, is located out of that ionization area to prevent deterioration of the filament 72.

Thus, while a preferred embodiment of the invention has been shown and described, it will be apparent to those skilled in the art that many other changes and modifications may be made without departing from the invention in its broader aspects. The appended claims are therefore intended to cover all such changes and modifications as fall within the true spirit and scope of the invention.

I claim:

1. An arc chamber assembly for use in an ionization source comprising:

a housing assembly:

a shield forming a chamber mounted within the housing assembly; said shield and said housing each having an aperture through them, said shield having a longitudinal axis;

mounting means for supporting the shield within the housing assembly in a centrally spaced relationship with the housing assembly and including an inlet conduit for supplying gas into the chamber through the housing assembly;

a filament located substantially within the chamber including two end sections and a central section located between the two end sections, each end section being connected to the central section by a loop, both loops being in generally parallel planes and being bent in diametrically opposite directions, the two end sections being aligned with one another along the longitudinal axis of the shield, the central section being parallel and offset from the two end sections; and means for supporting the filament within the chamber and electrically insulating the filament from the shields and the housing assembly.

2. An arc chamber assembly for use in an ionization source according to claim 1 wherein the housing assembly includes a base plates, a top plate having an interior surface, a shim plate mounted on the interior surface of the top plate, two side plates and two end plates, each side plate having an interior surface, each interior surface having a central portion which is generally vertical and an upper portion and a lower portion at an acute angle to the central portion, the two side plates and top plate and the base plate forming an elongated enclosure with a cross section generally shaped as a series of chords about a circle.

3. An arc chamber assembly for use in an ionization source according to claim 1 wherein the shield has a longitudinal axis and the main chamber has a main section which is generally cylindrical with a flat area along the longitudinal axis and has two end members, both end members having an exterior surface which is convex and an interior surface which is concave, one end member being rigidly affixed to the chamber, said chamber having an aperture through the flat area of the main section, said aperture through the chamber being rectangular and extending parallel to the longitudinal axis of the chamber and being aligned with the aperture in the housing assembly.

4. An arc chamber assembly for use in an ionization source comprising:

a housing assembly including a base plate, a top plate having an interior surface, a shim plate mounted on the interior surface of the top plate, two side plates and two end plate; each side plate having an interior surface, each interior surface having a central portion at an acute angle to the central portion which generally vertical and upper portion and a lower portion at an acute angle to the central portion, the two side plates and the top plate and the base plate forming an elongated enclosure with a cross section generally shaped as a series of chords about a circle, each side plate and each end plate having an opening through it, each opening being generally centrally located on the side plates and end plates, the shim plate and the top plate having an aperture through them, the aperture on the shim and the aperture in the top plate being generally aligned with one another, both apertures being rectangular;

a shield forming a chamber and having a main section which is generally cylindrical having a longitudinal axis with a flat area along the longitudinal axis of the main section and having two end members, both end members having an exterior surface which is convex and an interior surface which is concave, one end member being rigidly affixed to the chamber and the other end member being removable affixed to the chamber, said chamber having an aperture through the chamber being rectangular and extending parallel to the longitudinal axis of the chamber and being aligned with the aperture in the top plate and the aperture through the chamber being rectangular and extending parallel to the longitudinal axis of the chamber and being aligned with the aperture in the top plate and the aperture in the shim, said chamber further having a port opening located approximately at right angles to the aperture in the chamber and generally midway between the two end plates and aligned with the opening in one plate a side indentation in the chamber generally located opposite the port opening and a base indentation in the chamber located generally at right angles to the side indentation and the port opening each end member having an opening, both openings in the end members being generally aligned with each other along the longitudinal axis of the shield;

a filament located substantially within the chamber including two end sections and a central section located between the two end sections, each end section being connected to the central section by a loop, both loops lying in generally parallel planes and being bent in diametrically opposite directions, the two end portions being generally aligned with one another along the longitudinal axis of the shield, the central section being parallel to and offset from the two end sections;

grommets which are electrically nonconductive and heat resistant mounted in the openings in the end plates and the end members, each end section of the filament extending through one of the grommets to be connected to a source of electrical power;

an inlet conduit mounted in one side plate and the port opening for supplying gas into the arc shields, said inlet unit being heat resistant;

a base standoff unit mounted in the opening in the base plate protruding into the base indentation in the base and a side standoff unit mounted in the side plate opposite from the inlet port and protruding into the side indentation, both the base standoff unit and the side standoff unit being electrically insulating and being heat resistant; and bolt means for securing the side pates, top parts and shim, end plates and base plates together.

5. An arc chamber assembly for use in an ionization source a housing forming a chamber mounted within the housing assembly in a centrally spaced relationship with the housing assembly and including an inlet conduit for supplying gas into the chamber through the housing assembly;

a filament located substantially within the chamber including two end sections and a central section located between the two end section, means for connecting each end section to the central section, the two sections being aligned with one another along the longitudinal axis of the shield, the central section being parallel and offset from the two end sections; and means for supporting the filament within the chamber and electrically insulating the filament from the shield and the housing assembly.

6. An arc chamber assembly for use in an ionization source according to claim 5 wherein the multiplicity of plates includes a base plate, a top plate having an interior surface, a shim plate mounted on the interior surface of the top plate, two side plates and two end plates.

7. An arc chamber assembly for use in an ionization source according to claim 5 wherein the means for connecting the end sections to the central section of the filament includes a pair of loops, each loop lying in generally parallel planes.

8. An arc chamber assembly for use in an ionization source according to claim 5 wherein the means for connecting the end sections of the filament to the central section of the filament includes a pair of loops, both loops lying in generally parallel planes and being bent in diametrically opposite directions.

9. An arc chamber assembly for use in an ionization source according to claim 5 wherein the mounting means for supporting the shield includes standoff units and an inlet conduit.

10. An arc chamber assembly for use in an ionization source according to claim 5 wherein the multiplicity of plates included a base plate, a top plate, two side plates, and two end plates, said base plates and both side plates having openings therein, and the means for supporting the shield includes standoffs, one mounted in the opening in one side plate and the other located in the opening in the base plate, and an inlet conduit located in the opening in the other side plate.

* * * * *